US011135858B2

(12) United States Patent
Sakai

(10) Patent No.: US 11,135,858 B2
(45) Date of Patent: Oct. 5, 2021

(54) PRINTER

(71) Applicant: Roland DG Corporation, Hamamatsu (JP)

(72) Inventor: Chihiro Sakai, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/775,703

(22) Filed: Jan. 29, 2020

(65) Prior Publication Data

US 2020/0238738 A1 Jul. 30, 2020

(30) Foreign Application Priority Data

Jan. 30, 2019 (JP) ..... JP2019-014651

(51) Int. Cl.
*B41J 15/04* (2006.01)
*B41J 11/04* (2006.01)
(Continued)

(52) U.S. Cl.
CPC ..... *B41J 15/048* (2013.01); *B41J 11/04* (2013.01); *B41J 11/66* (2013.01); *B41J 15/042* (2013.01);
(Continued)

(58) Field of Classification Search
CPC . B41J 15/00; B41J 15/04; B41J 15/042; B41J 15/048; B41J 11/04; B41J 11/66;
(Continued)

(56) References Cited

U.S. PATENT DOCUMENTS 4,936,079 A * 6/1990 Skalsky ..... A47F 13/085 242/423.1
8,851,412 B2 * 10/2014 Tenpaku ..... B41J 15/042 242/533
(Continued)

FOREIGN PATENT DOCUMENTS

JP 58-095947 U 6/1983
JP 02-010343 U 1/1990
(Continued)

OTHER PUBLICATIONS

Machine translation of JP 2013-032206, published on Feb. 2013 (Year: 2013).*

*Primary Examiner* — Huan H Tran
(74) *Attorney, Agent, or Firm* — Keating & Bennett, LLP

(57) ABSTRACT

A printer includes a medium supplier including a shaft support, to which a supply shaft of a roll medium is detachably attached, a medium temporary placement support located below the shaft support of the medium supplier and that receives and supports the roll medium prior to being attached to the medium supplier, and a conveyor that conveys a medium in a conveyance direction that is perpendicular or substantially perpendicular to an axial direction of the supply shaft, the medium being unwound from the supply shaft. The medium temporary placement support includes a support bar that extends in the axial direction, and a placement seat supported by the support bar. The placement seat includes a placement surface on which the roll medium is placed and that extends in the conveyance direction, and a curved portion that includes a convex curve in an upstream end portion of the placement surface in the conveyance direction.

11 Claims, 10 Drawing Sheets

(51) Int. Cl.
*B65H 16/02* (2006.01)
*B41J 11/66* (2006.01)

(52) U.S. Cl.
CPC ..... *B65H 16/02* (2013.01); *B65H 2301/413* (2013.01)

(58) Field of Classification Search
CPC ..... B41J 11/706; B41J 3/4078; B41J 13/02; B41J 13/025; B41J 13/10; B41J 13/103; B65H 16/02; B65H 2301/413; B65H 2801/06; B65H 2511/112; B65H 2301/41387; B65H 16/028; B65H 16/06
See application file for complete search history.

(56) References Cited

U.S. PATENT DOCUMENTS

| | | | | |
|---|---|---|---|---|
| 2012/0187233 | A1 | 7/2012 | Tenpaku et al. | |
| 2017/0165983 | A1* | 6/2017 | Takahashi | B65H 19/126 |
| 2020/0001629 | A1* | 1/2020 | Takahashi | B41J 15/16 |

FOREIGN PATENT DOCUMENTS

| | | | | |
|---|---|---|---|---|
| JP | 2006-096552 | A | 4/2006 | |
| JP | 2011-131434 | A | 7/2011 | |
| JP | 2012-153456 | A | 8/2012 | |
| JP | 2013-032206 | * | 2/2013 | B41J 15/04 |
| JP | 2013-047139 | A | 3/2013 | |
| JP | 2015-129030 | A | 7/2015 | |

* cited by examiner

PRINTER

CROSS REFERENCE TO RELATED APPLICATIONS

This application claims the benefit of priority to Japanese Patent Application No. 2019-14651 filed on Jan. 30, 2019. The entire contents of this application are hereby incorporated herein by reference.

BACKGROUND OF THE INVENTION

1. Field of the Invention

The present invention relates to a printer. More specifically, the present invention relates to a printer including a medium temporary placement support on which a roll medium is temporarily placed before being attached to a medium supplier.

2. Description of the Related Art

Conventionally, a printer, which uses a roll medium including a supply shaft and a belt-shaped medium wound around the supply shaft for printing on the medium unwound from the supply shaft, has been known. In association with this, for example, a printer disclosed in JP-A-2012-153456 includes a holder that has a shaft support section supporting the supply shaft of the roll medium in such a manner as to allow rotation thereof; a temporary placement section that includes two bars located below the holder and provided parallel with each other in an axial direction of the supply shaft; and a roll medium lifting device having a placement section that is supported by the temporary placement section in a freely slidable manner and on which the roll medium is placed before being attached to the holder, and lifts the roll medium placed on the placement section, so as to assist in attachment of the supply shaft to the holder.

A printer that includes an ink head for discharging ink onto a medium on a platen, and a cutting head for cutting the medium on the platen is available. In such a printer, the printing operation is performed while the medium moves toward a downstream side in a conveyance direction. Thereafter, a large portion of the medium is fed backward to an upstream side in the conveyance direction, and a cutting operation is then performed thereon. At this time, in the case in which the large portion of the medium is fed backward to an upstream side, the medium possibly sags to the upstream side from the platen, and possibly hangs down to a side of or below the roll medium. As a result, in the printer disclosed in JP-A-2012-153456, there is a case in which the medium, which is fed backward, is stuck by the placement section, and is thereby folded or twisted.

SUMMARY OF THE INVENTION

Preferred embodiments of the present invention provide printers that significantly reduce or prevent a medium fed backward from being folded or twisted.

According to a preferred embodiment of the present invention, a printer is provided for printing on a roll medium that includes a supply shaft and a medium wound around the supply shaft. This printer includes a medium supplier including a shaft support, to which the supply shaft of the roll medium is detachably attached, and that rotatably supports the roll medium; a medium temporary placement support located below the shaft support of the medium supplier and that receives and supports the roll medium prior to the roll medium being attached to the medium supplier; and a conveyor that conveys a medium in a conveyance direction that is perpendicular or substantially perpendicular to an axial direction of the supply shaft, the medium being unwound from the supply shaft. The medium temporary placement support includes at least one support bar that extends in the axial direction, and a placement seat supported by the at least one support bar. The placement seat includes a placement surface on which the roll medium is placed and that extends in the conveyance direction and a curved portion that includes a convex curve in an upstream end portion of the placement surface in the conveyance direction.

According to a preferred embodiment of the present invention, the placement seat of the medium temporary placement support includes the curved portion in the upstream end portion. Accordingly, the medium, which is fed backward, is guided along the curved portion of the placement seat and thus is unlikely to be stuck by an upstream portion of the placement seat. Thus, even when a large portion of the medium is fed backward to the upstream side in the conveyance direction, it is possible to significantly reduce or prevent the medium from being folded or twisted.

Preferred embodiments of the present invention provide printers that are able to significantly reduce or prevent a medium, which is fed backward, from being folded or twisted.

DETAILED DESCRIPTION OF THE PREFERRED EMBODIMENTS

Figure 1:
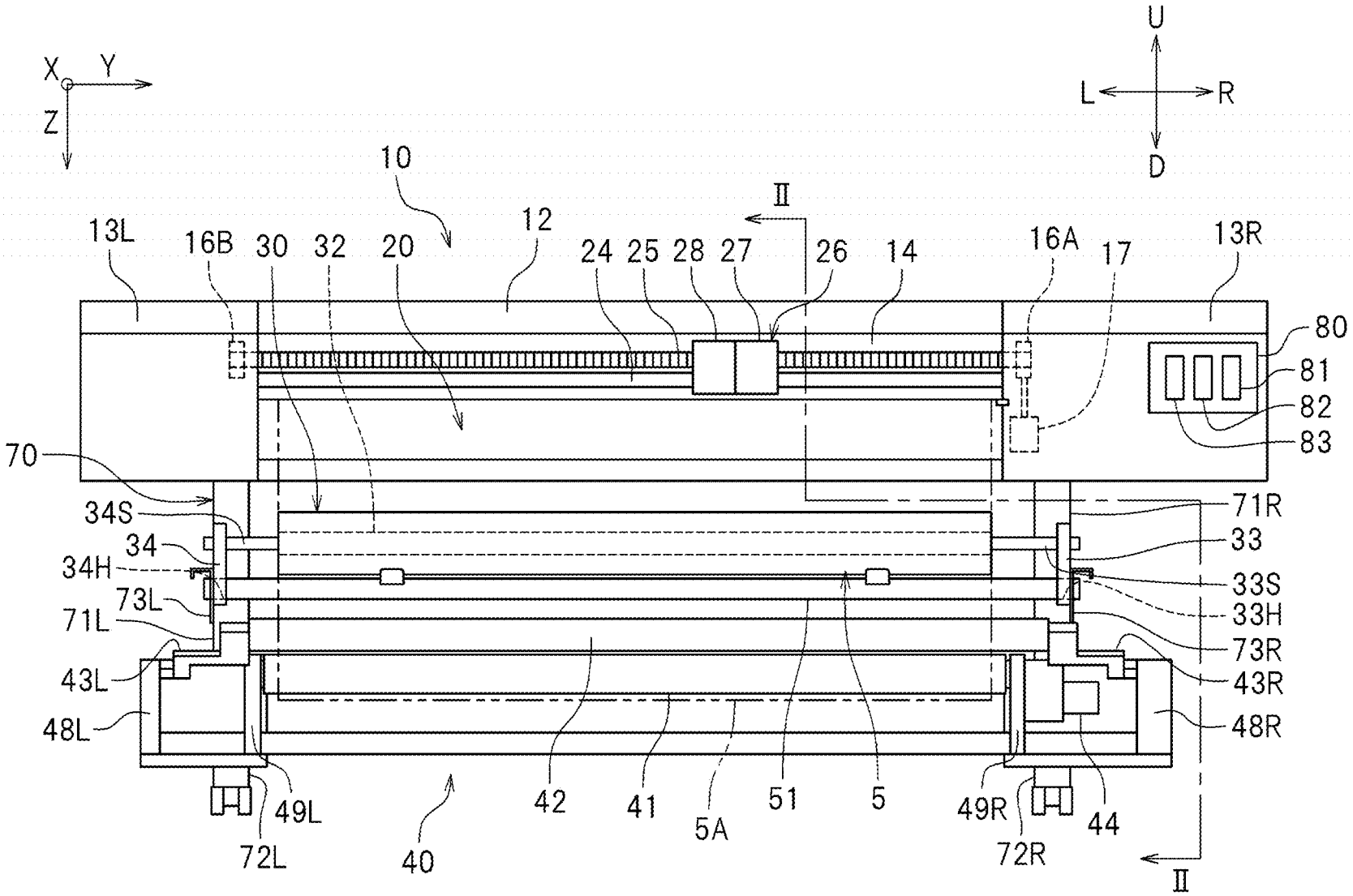
FIG. 1 is a front view of a printer according to a preferred embodiment of the present invention.

Description will hereinafter be made of printers according to preferred embodiments of the present invention with reference to the drawings. The preferred embodiments, which will be described herein, represent examples of the present invention for merely illustrative purposes, and the present invention is not limited to matters disclosed in the following preferred embodiments. Members and portions having the same operational effects will be denoted by the same reference numerals, and an overlapping description thereon will appropriately be omitted or simplified. In the present specification, the "printer" is a term including an inkjet printer, a laser printer, a dot impact printer, a thermal printer, a thermal-transfer printer, and the like.

Figure 2:
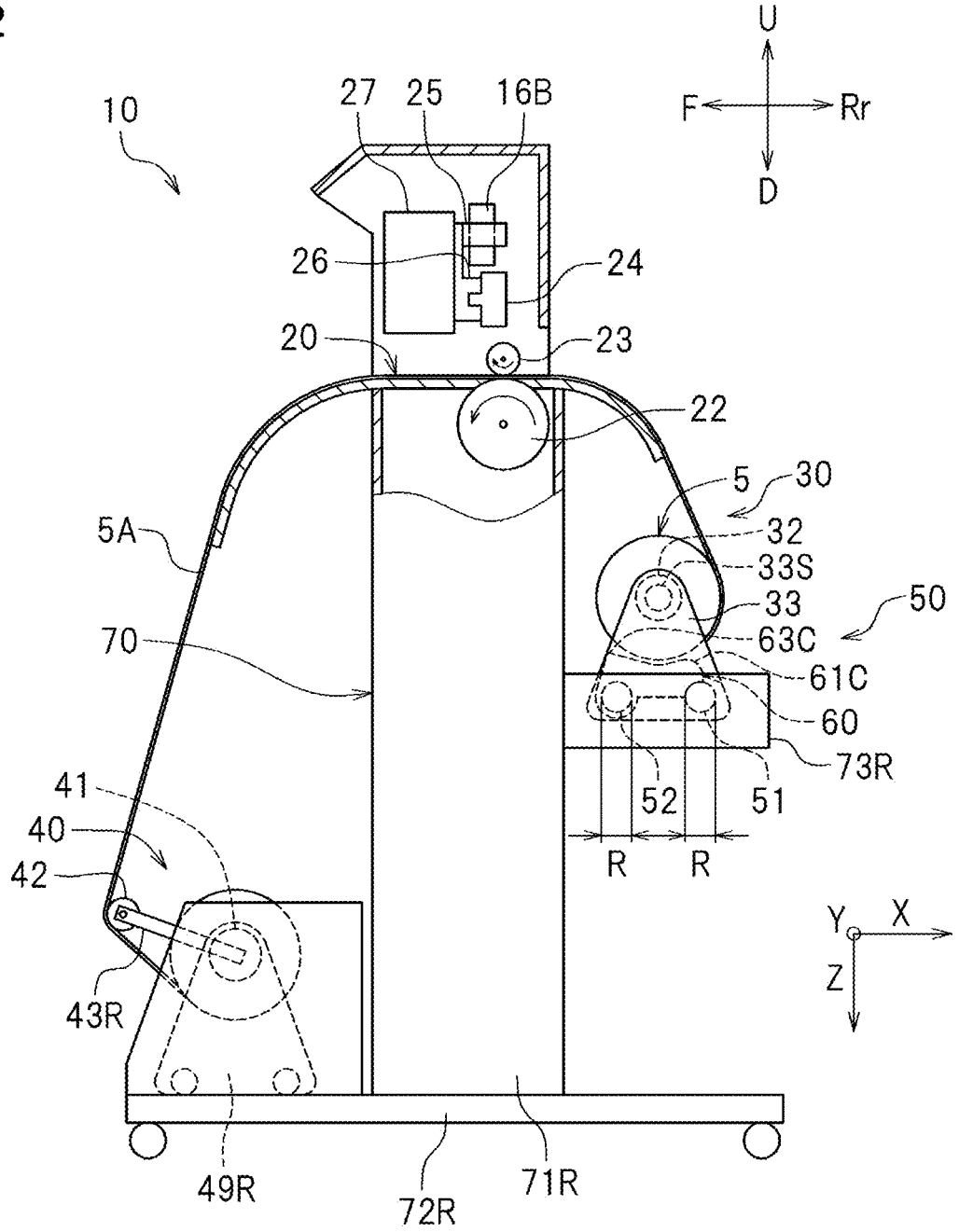
FIG. 2 is a cross-sectional view taken along line II-II of the printer shown in FIG. 1.
Figure 3:
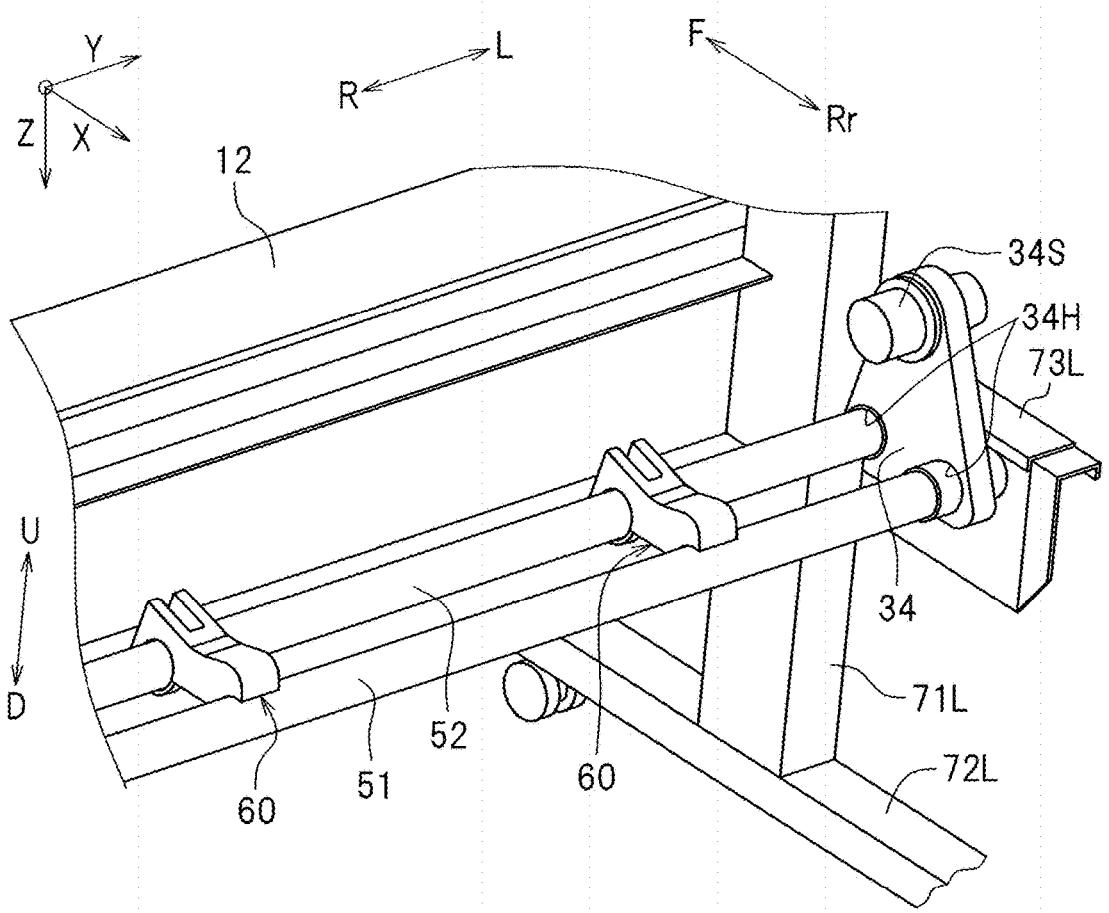
FIG. 3 is a partial perspective view in which a back surface of the printer shown in FIG. 1 is seen from above.

FIG. 1 is a front view of an inkjet printer including a cutting head (hereinafter may simply be referred to as a "printer") 10. FIG. 2 is a cross-sectional view taken along line II-II in FIG. 1. FIG. 3 is a partial perspective view in which the printer 10 is seen from a back surface side and above, and shows a state before a roll medium 5 is placed thereon. The printer 10 includes the cutting head and is capable of printing on and cutting a medium 5A. In the following description, left, right, up, and down respectively refer to left, right, up, and down as seen by a user (a user of the printer 10) present in front of the printer 10, and a near side of the printer 10 and a far side of the printer 10 from the user will respectively be referred to as a front side and a rear side. In addition, the reference symbols F, Rr, L, R, U, and D in the drawings respectively indicate front, rear, left, right, up, and down, and the reference symbols X, Y, and Z in the drawings respectively indicate a longitudinal direction, a lateral direction, and a vertical direction. Note that these are merely directions defined for the purpose of convenience of the description and thus do not limit an installation mode of the printer 10 in any respect.

In the present specification, the "inkjet printer" includes any printer that uses a printing method using a conventionally known inkjet technique, for example, a continuous method such as a two-valued deflection method or a continuous deflection method, a thermal method, or any of various on-demand methods including a piezo element method. In addition, in the present specification, "cut" and "cutting" include a case in which the entire medium 5A is cut in a thickness direction (for example, a case in which both of a mat board and a paper liner of a sealing material are cut), and a case in which a portion of the medium 5A is cut in the thickness direction (for example, a case in which the mat board of the sealing material is not cut but only the paper liner is cut).

The printer 10 prints on the medium 5A unwound from the roll medium 5. As shown in FIG. 2, the roll medium 5 includes a supply shaft 32 that extends in a lateral direction Y, and the medium 5A that is wound around the supply shaft 32. The roll medium 5 is configured such that the belt-shaped medium 5A is wound in a roll shape around a circumferential surface of the supply shaft 32. The medium 5A only needs to have a shape that is able to be wound around the supply shaft 32, and thus the shape thereof is not particularly limited. The medium 5A may be any type of paper such as regular paper or inkjet printing paper, a sheet or a film made of a resin such as polyvinyl chloride or polyester, fabric such as woven fabric or unwoven fabric, or another medium, for example. The roll medium 5A may be a sealing material including a mat board and a paper liner that is stacked on the mat board and is applied with an adhesive. Herein, a longitudinal direction of the medium 5A is a longitudinal direction X, and a width direction (see FIG. 1) of the medium 5A is the lateral direction Y. An axial direction of the supply shaft 32 corresponds to the lateral direction Y.

As shown in FIG. 1, the printer 10 includes a casing 12, a left-side cover 13L, a right-side cover 13R, a platen 20, a guide rail 24, a carriage 26, a belt 25, an ink head 27, a cutting head 28, a base 70, and a controller 80. As shown in FIG. 2, the printer 10 also includes a grit roller 22, a pinch roller 23, a medium supplier 30, a medium winding device 40, and a medium temporary placement support 50.

As shown in FIG. 1, the base 70 supports the casing 12, the platen 20, and the like. The base 70 is located below the casing 12 and the platen 20. The base 70 includes a first left leg 71L, a second left leg 72L, a first right leg 71R, and a second right leg 72R. As shown in FIG. 2, the first left leg 71L and the first right leg 71R extend in the vertical direction. The second left leg 72L extends in the longitudinal direction X from a lower end of the first left leg 71L. The second right leg 72R extends in the longitudinal direction X from a lower end of the first right leg 71R.

As shown in FIG. 1, the casing 12 is supported by the base 70. More specifically, the casing 12 is supported by the first left leg 71L and the first right leg 71R. The casing 12 extends in the lateral direction Y. The left-side cover 13L is provided on a left end of the casing 12. The right-side cover 13R is provided on a right end of the casing 12. The casing 12 is provided with a central wall 14 that extends in the vertical direction. The central wall 14 extends in the lateral direction Y. The central wall 14 couples the left-side cover 13L and the right-side cover 13R. In FIG. 2, the central wall 14 is not shown.

The platen 20 supports the medium 5A from below when printing on or cutting of the medium 5A is performed. At least a portion of the platen 20 is provided in the casing 12. As shown in FIG. 1, the platen 20 extends in the lateral direction Y. As shown in FIG. 2, the platen 20 is located on a downstream side of the medium supplier 30 in a conveyance direction of the medium 5A. The platen 20 is located on an upstream side of the medium winding device 40 in the conveyance direction of the medium 5A. The platen 20 is located in the front F of the medium supplier 30 and the medium temporary placement support 50. The platen 20 is located above U the medium supplier 30 and the medium temporary placement support 50. The medium 5A that is unwound from the roll medium 5 is placed on the platen 20. Printing on and cutting of the medium 5A are performed on the platen 20.

As shown in FIG. 2, the platen 20 is provided with the cylindrical grit roller 22. The grit roller 22 is embedded in the platen 20 in a state in which an upper surface portion thereof is exposed. The grit roller 22 is driven by a feed motor (not shown). The grit roller 22 causes the medium 5A, which is unwound from the roll medium 5, to move in the longitudinal direction X. The grit roller 22 is an example of a conveyor. The pinch roller 23 is located above U the grit roller 22. The pinch roller 23 opposes the grit roller 22. The pinch roller 23 is vertically movable. When the pinch roller 23 moves downward D, the medium 5A is held between the grit roller 22 and the pinch roller 23. When the grit roller 22 rotates in the state in which the medium 5A is held between the grit roller 22 and the pinch roller 23, the medium 5A is conveyed to the downstream side in the conveyance direction (to the front F in the longitudinal direction X) or to the upstream side in the conveyance direction (to the rear Rr in the longitudinal direction X).

As shown in FIG. 1, the guide rail 24 is provided on the central wall 14. The guide rail 24 is located above U the platen 20. The guide rail 24 extends in the lateral direction Y. The guide rail 24 is parallel or substantially parallel with the platen 20. The carriage 26 is engaged with the guide rail 24 (see FIG. 2). The carriage 26 is movable or slidable in the lateral direction Y along the guide rail 24. The endless belt 25 is fixed to a rear portion of the carriage 26 (see FIG. 2). The belt 25 extends in the lateral direction Y. The belt 25 is parallel or substantially parallel with the platen 20. The belt 25 is wound around a drive pulley 16A located on a right end side of the guide rail 24 and a driven pulley 16B located on a left end side of the guide rail 24. The drive pulley 16A is connected to a carriage motor 17. When the carriage motor 17 causes the drive pulley 16A to rotate, the belt 25 runs in the lateral direction Y, and the carriage 26, which is fixed to the belt 25, moves in the lateral direction Y.

As shown in FIG. 1, the inkjet ink head 27 and the cutting head 28 are mounted on the carriage 26. The ink head 27 is located above U the platen 20. Although not shown, the ink head 27 includes a plurality of nozzles, each of which opens downward D, and discharges ink from each of the nozzles onto the medium 5A. Note that a type of the ink is not particularly limited. The ink may be ink that hardens when being irradiated with ultraviolet rays (so-called UV ink), or may be a solvent ink such as of an eco-solvent type, for example. When the carriage 26 moves in the lateral direction Y, the ink head 27 also moves in the lateral direction Y. The ink head 27 discharges the ink onto the medium 5A on the platen 20 while moving in the lateral direction Y.

The cutting head 28 is located above U the platen 20. Although not shown, the cutting head 28 includes a cutter that cuts the medium 5A. When the carriage 26 moves in the lateral direction Y, the cutting head 28 also moves in the lateral direction Y. The cutting head 28 cuts the medium 5A on the platen 20 while moving in the lateral direction Y. Note that, although the ink head 27 and the cutting head 28 are mounted on the same carriage 26 in the present preferred embodiment, the ink head 27 and the cutting head 28 may separately mounted on different carriages and may move independently from each other. In addition, the cutting head 28 is not an essential component, and thus may not be provided in other preferred embodiments of the present invention. Furthermore, in addition to the ink head 27 and the cutting head 28, an irradiation device that emits light (for example, ultraviolet rays) may be mounted on the carriage 26.

The medium supplier 30 axially supports the roll medium 5 before printing, and supplies the medium 5A. As shown in FIG. 1, the medium supplier 30 includes a right bracket 73R that is fixed to the base 70, a holder 33 that is supported by the right bracket 73R, and a shaft support 33S that is provided in the holder 33. The medium supplier 30 also includes a left bracket 73L that is fixed to the base 70, a holder 34 that is supported by the left bracket 73L, and a shaft support 34S that is provided in the holder 34 (also see FIG. 2). The shaft supports 33S, 34S are located at the same or substantially the same height. The supply shaft 32 of the roll medium 5 is detachably attached to the shaft supports 33S, 34S, and the supply shaft 32 is thus rotatably supported. On the upstream side of the platen 20 in the conveyance direction of the medium 5A, the shaft supports 33S, 34S are each located at the rear Rr of and downward portion D of the platen 20 (also see FIG. 2). The shaft supports 33S, 34S are located above U the medium temporary placement support 50. The shaft supports 33S, 34S are located right above the medium temporary placement support 50.

As shown in FIG. 1, the holder 33 is located on the right side of the holder 34. As shown in FIG. 2 and FIG. 3, each of the holders 33, 34 is preferably a plate-shaped member that has a triangular or substantially triangular shape. The holders 33, 34 are respectively supported by the right bracket 73R and the left bracket 73L via slide bars 51, 52, which will be described below. The shaft supports 33S, 34S are respectively provided in apex portions of the triangular shapes of the holders 33, 34. The shaft support 33S projects toward the holder 34. The shaft support 34S projects toward the holder 33. As shown in FIGS. 1 to 3, two insertion holes 33H, 34H penetrate two corner portions (that is, a corner portion on the upstream side and a corner portion on the downstream side in the conveyance direction) on a bottom side of the triangular shapes of the holders 33, 34. The slide bars 51, 52 extend through the insertion holes 33H, 34H.

Each of the holders 33, 34 is provided in a slidable manner on the slide bars 51, 52. A position of each of the holders 33, 34 in the lateral direction Y is able to be changed along the slide bars 51, 52. The holders 33, 34 move in such a manner as to approach or separate from each other along the slide bars 51, 52 in accordance with a width of the roll medium 5 in the lateral direction Y, for example. In this way, a distance in the lateral direction Y between the first holder 33 and the second holder 34 is adjusted. In the present preferred embodiment, the printer 10 does not include a motor that causes the supply shaft 32 to rotate. Accordingly, when the grit roller 22 conveys the medium 5A to the downstream side in the conveyance direction, the medium 5A is unwound from the supply shaft 32 and is fed toward the platen 20. Although the medium supplier 30 of the present preferred embodiment does not include the motor that causes the supply shaft 32 to rotate, the medium supplier 30 may include such a motor in other preferred embodiments of the present invention.

The medium winding device 40 winds the printed medium 5A in the roll shape. As shown in FIG. 2, the medium winding device 40 includes a winding shaft 41, a tension bar 42, and a right support arm 43R. As shown in FIG. 1, the medium winding device 40 also includes a left support arm 43L and a winding motor 44. The medium winding device 40 is fixed to the base 70. More specifically, the medium winding device 40 is located on the second left leg 72L and the second right leg 72R. As shown in FIG. 2, the winding shaft 41 is located on the downstream side of the platen 20 in the conveyance direction of the medium 5A. The winding shaft 41 is located in the front F of and downward portion D of the platen 20. As shown in FIG. 1, herein, the winding shaft 41 preferably has a cylindrical shape that extends in the lateral direction Y. The winding shaft 41 is attached to the medium winding device 40 in a freely detachable manner. A left end portion of the winding shaft 41 is rotatably supported by a second left-side wall 49L that is provided on the second left leg 72L. A right end portion of the winding shaft 41 is rotatably supported by a second right-side wall 49R that is provided on the second right leg 72R.

As shown in FIG. 2, the tension bar 42 is parallel or substantially parallel with the winding shaft 41. Herein, the tension bar 42 preferably has a cylindrical shape that extends in the lateral direction Y. The tension bar 42 uses its own weight to press the medium 5A obliquely downwards to the front, and thus applies a tensile force to a portion of the medium 5A between the platen 20 and the winding shaft 41. The left support arm 43L and the right support arm 43R support the tension bar 42 in such a manner as to allow swinging thereof. As shown in FIG. 1, the left support arm 43L is swingably provided on a first left-side wall 48L. The right support arm 43R is swingably provided on a first right-side wall 48R. The winding motor 44 is coupled to the winding shaft 41. The winding motor 44 is located between the first right-side wall 48R and the second right-side wall 49R. The winding motor 44 causes the winding shaft 41 to rotate. When the winding shaft 41 rotates by driving the winding motor 44, the winding shaft 41 winds the medium 5A.

The medium temporary placement support 50 receives and supports the roll medium 5 prior to the roll medium 5 being attached to the medium supplier 30. As shown in FIG. 2 and FIG. 3, the medium temporary placement support 50 includes the two slide bars 51, 52 and two placement seats 60, each of which is attached to the two slide bars 51, 52. The slide bars 51, 52 and the placement seats 60 are located at the rear Rr of and downward portion D of the platen 20. The slide bars 51, 52 and the placement seats 60 are located at the downward portion D of the shaft supports 33S, 34S of the medium supplier 30. The roll medium 5 is typically placed on the medium temporary placement support 50 such that a width direction thereof is horizontal or substantially horizontal.

As shown in FIG. 2 and FIG. 3, each of the slide bars 51, 52 extends in the lateral direction Y. The slide bars 51, 52 extend parallel or substantially parallel with the supply shaft 32. Left end portions of the slide bars 51, 52 are each fixed to the left bracket 73L that is provided on the first left leg 71L. Right end portions of the slide bars 51, 52 are each fixed to the right bracket 73R that is provided on the first right leg 71R. The slide bars 51, 52 are parallel or substantially parallel with each other at separate positions in the longitudinal direction X. The slide bars 51, 52 are located at the same or substantially the same height in the vertical direction Z. Each of the slide bars 51, 52 extends through the insertion holes 33H, 34H of the holders 33, 34. Each of the slide bars 51, 52 is made of metal such as iron or stainless steel, for example. Although a shape of each of the slide bars 51, 52 is not particularly limited, each of the slide bars 51, 52 preferably has a rod shape, for example. Herein, each of the slide bars 51, 52 has a cylindrical shape whose diameter R (a length in the longitudinal direction X) is about 20 mm, for example. However, each of the slide bars 51, 52 may have a columnar shape, an oval columnar shape, a polygonal columnar shape, a plate shape, or the like. In addition, the number of the slide bars 51, 52 is not limited to two. Each of the slide bars 51, 52 is an example of the support bar.

In the following description, the slide bar that is located on the upstream side in the conveyance direction (at the rear Rr in the longitudinal direction X), in other words, located on a relatively far side from the platen 20 will also be referred to as the "upstream slide bar 51". In addition, the slide bar that is located on the downstream side in the conveyance direction (at the front F in the longitudinal direction X), in other words, located on a relatively near side of the platen 20 will also be referred to as the "downstream slide bar 52". As shown in FIG. 2, the upstream slide bar 51 is located at the rear Rr of the supply shaft 32. The downstream slide bar 52 is located in the front F of the supply shaft 32. The downstream slide bar 52 is located on the downstream side of the upstream slide bar 51.

Each of the placement seats 60 temporarily receives the roll medium 5, that is, a seat which receives and supports the roll medium 5 prior to the roll medium 5 being attached to the medium supplier 30. As shown in FIG. 3, each of the placement seats 60 is supported by the slide bars 51, 52. Each of the placement seats 60 extends in the longitudinal direction X. Each of the placement seats 60 hangs by the slide bars 51, 52. Each of the placement seats 60 is provided in a freely slidably manner in the lateral direction Y along the slide bars 51, 52. Each of the placement seats 60 is made of resin, for example. In the present preferred embodiment, each of the placement seats 60 is integrally shaped by integral processing using a shaping mold, for example. However, each of the placement seats 60 may be made by assembling a plurality of members.

Figure 4A:
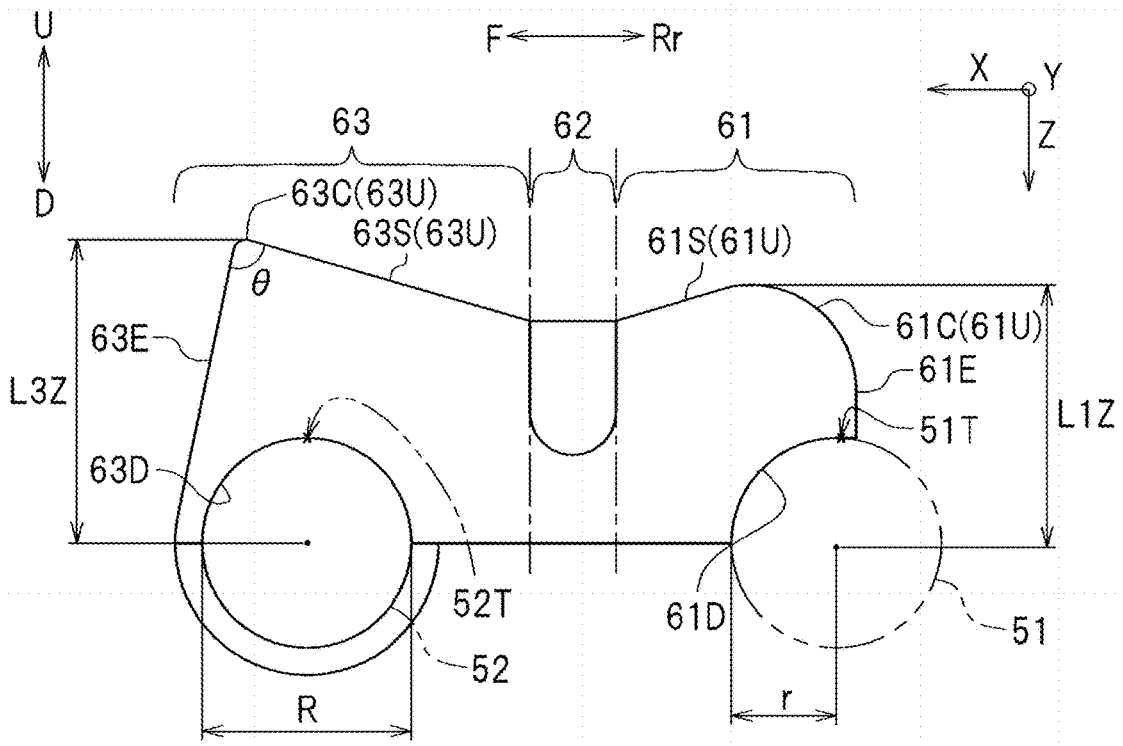
FIG. 4A is a schematic side view of a placement seat according to a preferred embodiment of the present invention.
Figure 4B:
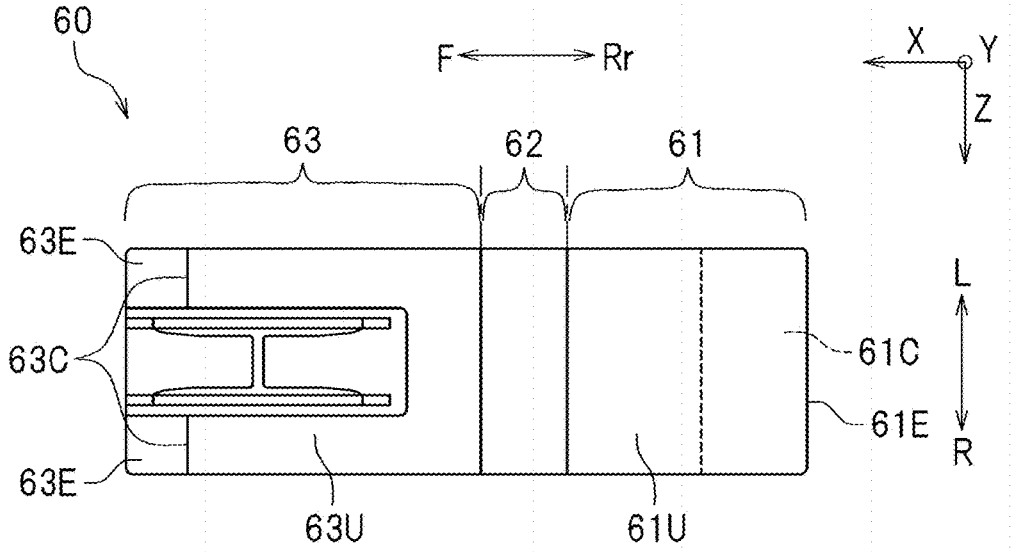
FIG. 4B is a top view of the placement seat shown in FIG. 4A.
Figure 4C:
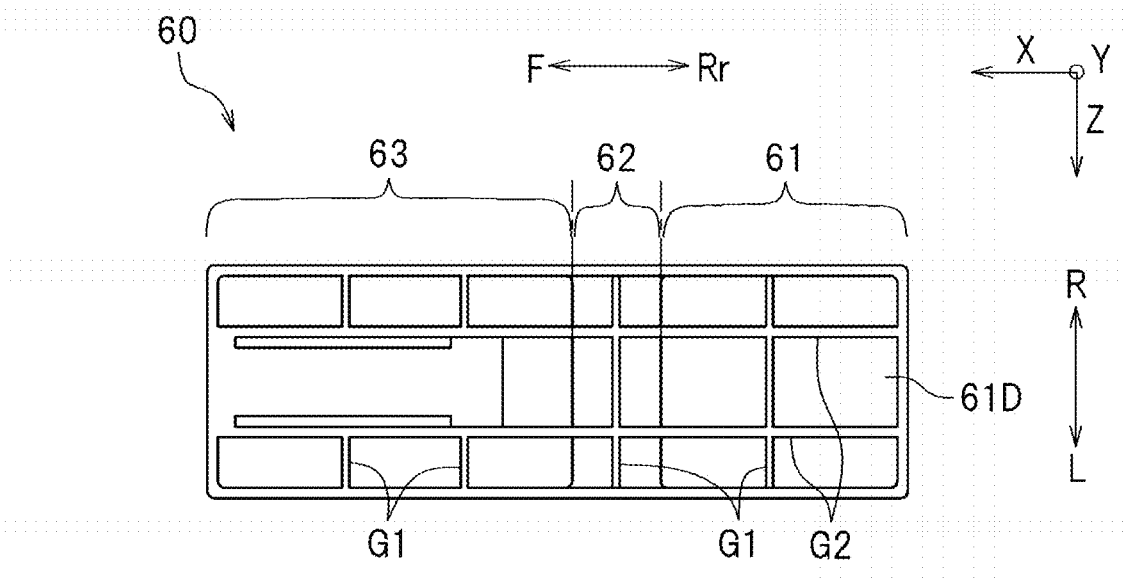
FIG. 4C is a bottom view of the placement seat shown in FIG. 4A.

FIG. 4A is a schematic side view of the placement seat 60. FIG. 4B is a top view of the placement seat 60. FIG. 4C is a bottom view of the placement seat 60. As shown in FIG. 4A, the placement seat 60 includes an upstream-side placement surface 61U and a downstream-side placement surface 63U, on each of which the roll medium 5 is placed; a curved portion 61C in an upstream (the rear Rr in the longitudinal direction X) end portion of the upstream-side placement surface 61U; a corner portion 63C on a downstream (the front F in the longitudinal direction X) end portion of the downstream-side placement surface 63U; and an arc-shaped R portion 61D and a through hole 63D that are respectively supported by the slide bars 51, 52.

The placement seat 60 is divided into an upstream portion 61 that is engaged with the upstream slide bar 51; a downstream portion 63 that is engaged with the downstream slide bar 52; and an intermediate portion 62 that couples the upstream portion 61 and the downstream portion 63. In the present preferred embodiment, when the placement seat 60 is divided into two in the longitudinal direction X, the upstream portion 61 and the intermediate portion 62 correspond to a first portion that is relatively located on the upstream side, and the downstream portion 63 corresponds to a second portion that is relatively located on the downstream side. The placement seat 60 preferably has an asymmetrical shape in the longitudinal direction X. Accordingly, it is possible to prevent erroneous assembly of the placement seat 60 in the longitudinal direction X during manufacturing of the printer 10, for example. The placement seat 60 may be assembled to the printer 10 in such a manner as to disallow detachment thereof.

In a state of being supported by the slide bars 51, 52, the upstream portion 61 and the downstream portion 63 of the placement seat 60 are located at higher positions in the vertical direction Z than the intermediate portion 62 from the slide bars 51, 52. Accordingly, when the roll medium 5 is placed on an upper surface of the placement seat 60, a position of the roll medium 5 is stabilized. In the vertical direction Z, the highest position of the upstream portion 61 is lower than the highest position of the downstream portion 63. The highest position of the placement seat 60 is located in the downstream portion 63. In addition, in the vertical direction Z, a perpendicular length L1Z from the highest position of the upstream portion 61 to a center line of the upstream slide bar 51 in the vertical direction Z is shorter than a perpendicular length L3Z from the highest position of the downstream portion 63 to a center line of the downstream slide bar 52. That is, L1Z<L3Z. In this way, the movement of the medium 5A, which is fed backward, is further unlikely to be hindered by the placement seat 60. Although not particularly limited, the perpendicular length L1Z and/or the perpendicular length L3Z described above may be longer than the diameter R of each of the slide bars 51, 52. Accordingly, the position of the roll medium 5 is further stabilized by preventing teetering of the roll medium 5 on the placement seat 60.

As shown in FIG. 4A, the upper surfaces of the upstream portion 61 and the downstream portion 63 are respectively provided with the upstream-side placement surface 61U and the downstream-side placement surface 63U. The upstream-side placement surface 61U and the downstream-side placement surface 63U contact the roll medium 5 when the roll medium 5 is placed on the placement seat 60. In the present preferred embodiment, each of the upstream-side placement surface 61U and the downstream-side placement surface 63U is an example of the placement surface on which the roll medium 5 is placed.

The upstream-side placement surface 61U includes an inclined surface 61S that extends obliquely upwards to the rear from an upstream end portion of the intermediate portion 62 in a state of being supported by the slide bars 51, 52, and the curved portion 61C that extends from an upstream end portion of the inclined surface 61S and is curved to the upward portion U. On the inclined surface 61S, the position in the vertical direction Z is gradually elevated from the upstream end portion of the intermediate portion 62 toward the curved portion 61C. A length of the inclined surface 61S in the longitudinal direction X is set based on an outer shape of the roll medium 5. The length of the inclined surface 61S in the longitudinal direction X is set such that a length that prevents rolling of the roll medium 5 is secured in addition to a length required to stably hold the largest roll medium 5 to be estimated (the length of the inclined surface 61S, which will be described below). In this way, the position of the roll medium 5 is further stabilized. In addition, when an area that is able to contact the roll medium 5 is increased and the roll medium 5 is placed, teetering of the roll medium 5 is further prevented.

The curved portion 61C is curved gently in comparison with the corner portion 63C, which will be described below. Curvature of the curved portion 61C is preferably equal to or smaller than a curvature of the upstream slide bar 51. The curved portion 61C is connected to an upstream end surface 61E. The upstream-side placement surface 61U does not include a convex portion (for example, a portion that is projected at an acute angle from the upper surface).

The downstream-side placement surface 63U includes an inclined surface 63S that extends obliquely upwards to the front from a downstream end portion of the intermediate portion 62 in a state of being supported by the slide bars 51, 52, and the corner portion 63C that extends from a downstream end portion of the inclined surface 63S and is projected to the upward portion U. The corner portion 63C functions as a weir that prevents rolling of the roll medium 5 to the front F. On the inclined surface 63S, the position in the vertical direction Z is gradually elevated from the downstream end portion of the intermediate portion 62 toward the corner portion 63C. Here, an absolute inclination angle (an inclination from a horizon) of the inclined surface 63S is equal to an absolute inclination angle of the inclined surface 61S. A length of the inclined surface 63S in the longitudinal direction X is set based on the outer shape of the roll medium 5. The length of the inclined surface 63S in the longitudinal direction X is set in consideration of a length required to stably hold the largest roll medium 5 to be estimated. In this way, the position of the roll medium 5 is further stabilized. In addition, when the area that is able to contact the roll medium 5 is increased and the roll medium 5 is placed, teetering of the roll medium 5 is prevented.

The corner portion 63C has a specified bent angle θ. The bent angle θ is defined by the inclined surface 63S and a downstream end surface 63E of the placement seat 60. Although not particularly limited, the bent angle θ is perpendicular or substantially perpendicular (about 90°). However, the bent angle θ may be an obtuse angle (90°<θ<180°), for example. The corner portion 63C is connected to the downstream end surface 63E. The downstream end surface 63E is inclined obliquely downwards to the front from the corner portion 63C. The downstream end surface 63E has a draft angle for the purpose of integral shaping of the placement seat 60.

As it is understood from comparison between FIG. 4B and FIG. 4C, the upstream-side placement surface 61U is more even and flatter than a lower surface of the upstream portion 61. Similarly, the downstream-side placement surface 63U is more even and flatter than a lower surface of the downstream portion 63. An upper surface of the intermediate portion 62 may contact or may not contact the roll medium 5. Herein, the upper surface of the intermediate portion 62 preferably is flat. However, the upper surface of the intermediate portion 62 may have a V-shaped or U-shaped cross-sectional shape.

As shown in FIG. 4A, the upstream portion 61 includes the arc-shaped R portion 61D that follows the upstream slide bar 51. The R portion 61D contacts the upstream slide bar 51 when the roll medium 5 is placed on the placement seat 60. The R portion 61D locks the placement seat 60 to the upstream slide bar 51. Herein, a curvature of the R portion 61D is equal or substantially equal to the curvature of the upstream slide bar 51. The R portion 61D contacts an uppermost position 51T of the upstream slide bar 51. In a plan view, the R portion 61D overlaps the uppermost position 51T of the upstream slide bar 51. The R portion 61D preferably covers about one-fourth or more, for example, of an outer circumferential surface of the upstream slide bar 51. Here, the R portion 61D contacts the outer circumferential surface that corresponds to about one-fourth of the outer circumferential surface of the upstream slide bar 51 and that is located on the downstream side in the conveyance direction (at the front F in the longitudinal direction X) and the upper side in the vertical direction Z. The R portion 61D does not contact the outer circumferential surface on the upstream side in the conveyance direction (at the rear Rr in the longitudinal direction X) of the outer circumferential surface of the upstream slide bar 51. Accordingly, an upstream end portion of the placement seat 60 is located on the downstream side of an upstream end portion of the upstream slide bar 51. The placement seat 60 does not stick out to the rear Rr from the upstream slide bar 51. Accordingly, the medium 5A, which is fed backward, is unlikely to be stuck by the upstream portion 61.

A length of the R portion 61D (a length in the longitudinal direction X of an area of the R portion 61D covering the slide bar) is preferably equal to or longer than πR/4 when the diameter of the upstream slide bar 51 is set as R. In this way, when the roll medium 5 is placed on the placement seat 60, the position of the roll medium 5 is further stabilized. On the contrary, as the length of the R portion 61D is increased, a projection amount of the upstream portion 61 to the rear Rr is increased. As a result, the upstream portion 61 is likely to interfere with a medium path at the time when the medium 5A is fed backward. The R portion 61D may cover less than about half of the outer circumference of the upstream slide bar 51 at the maximum, and preferably covers slightly more than about one-fourth of the outer circumference of the upstream slide bar 51. Accordingly, the path of the medium 5A, which is fed backward, is appropriately secured.

The downstream portion 63 includes the through hole 63D. The through hole 63D has a diameter that is equal to or larger than an outer diameter of the downstream slide bar 52, and penetrates the downstream portion 63 in the lateral direction Y. The through hole 63D surrounds the entire circumference of the downstream slide bar 52. An upper half of the through hole 63D is in contact with the downstream slide bar 52. The through hole 63D contacts the highest position 52T of the downstream slide bar 52. The downstream slide bar 52 penetrates the through hole 63D in a freely slidable manner. The placement seat 60 is rotatable about the downstream slide bar 52 in the longitudinal direction X. Note that the through hole 63D may not surround the entire circumference of the downstream slide bar 52 and, for example, may only cover an upper half or a portion of the upper half and a lower half of the downstream slide bar 52.

As shown in FIG. 4C, the lower surfaces of the upstream portion 61 and the downstream portion 63 include first ribs G1 extending along the lateral direction Y and second ribs G2 extending along the longitudinal direction X. In this way, rigidity of the placement seat 60 is secured. Thus, for example, even the roll medium 5 having a large medium diameter and the heavy roll medium 5 may be temporarily placed on the placement seat 60.

Figure 4D:
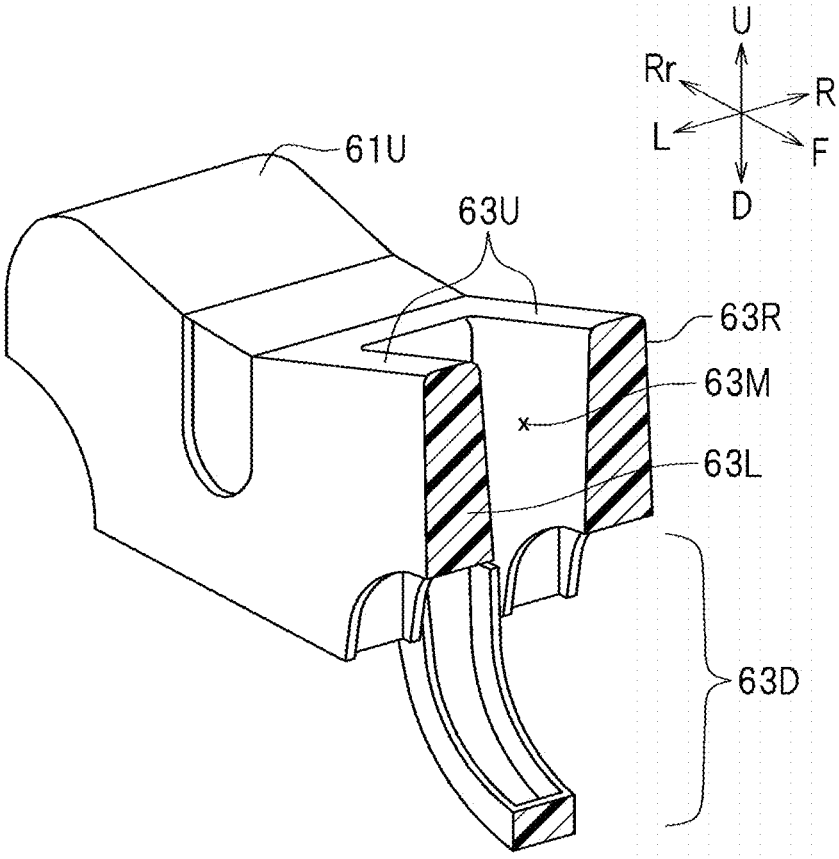
FIG. 4D is a side view in which the placement seat shown in FIG. 4A is partially cut.
Figure 4E:
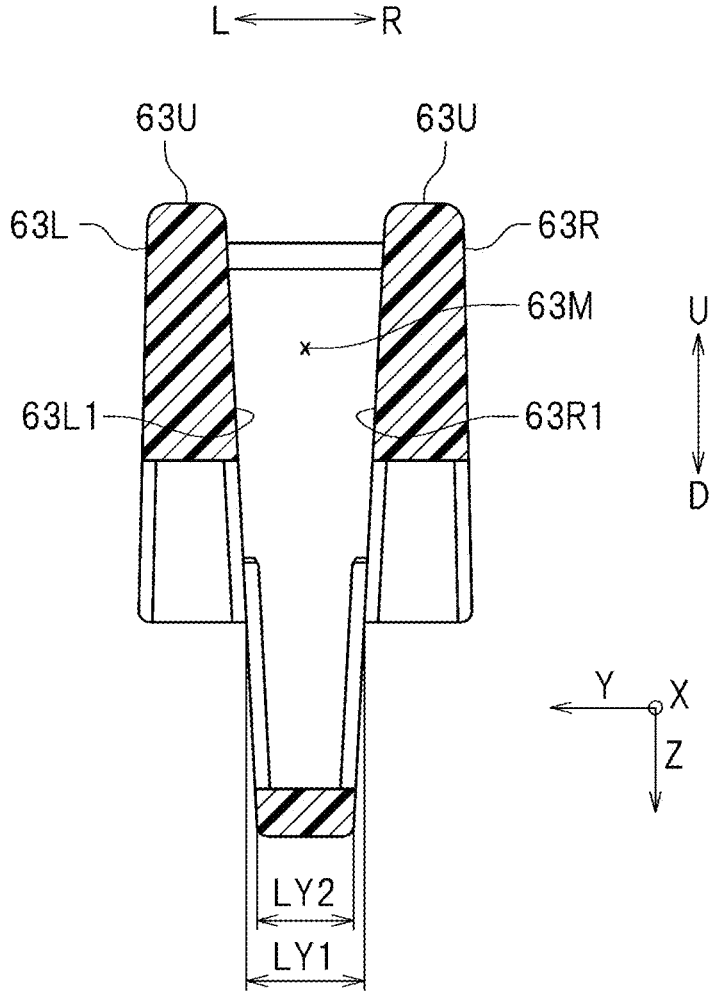
FIG. 4E is a cross-sectional view of the placement seat shown in FIG. 4D.

FIG. 4D is a side view in which the downstream portion 63 of the placement seat 60 is cut perpendicular to the vertical direction Z. FIG. 4E is a cross-sectional view of a cut surface in FIG. 4D. As shown in FIG. 4D and FIG. 4E, a cross section of the downstream portion 63 includes a pair of lateral surfaces 63R, 63L that oppose the lateral direction Y. Each of the lateral surfaces 63R, 63L has a trapezoidal cross section, for example. Each of the lateral surfaces 63R, 63L has the draft angle for the purpose of integral shaping of the placement seat 60. The lateral surfaces 63R, 63L respectively include inner walls 63R1, 63L1, each of which is inclined upwards from a bottom side. The lateral surfaces 63R, 63L separate from each other in the lateral direction Y, and a space 63M is provided between the lateral surfaces 63R, 63L. The through hole 63D is located at the downward portion D of the space 63M. The space 63M is used to remove the shaping mold when the mold is opened. In the lateral direction Y, a length LY1 of the narrowest portion of the space 63M is longer than a length L2Y of the through hole 63D. For example, the placement seat 60 may be manufactured when the shaping mold that includes two mold frames of an upper mold and a lower mold is filled with resin, the resin hardens, and thereafter the shaping mold is removed in the vertical direction Z.

Figure 5:
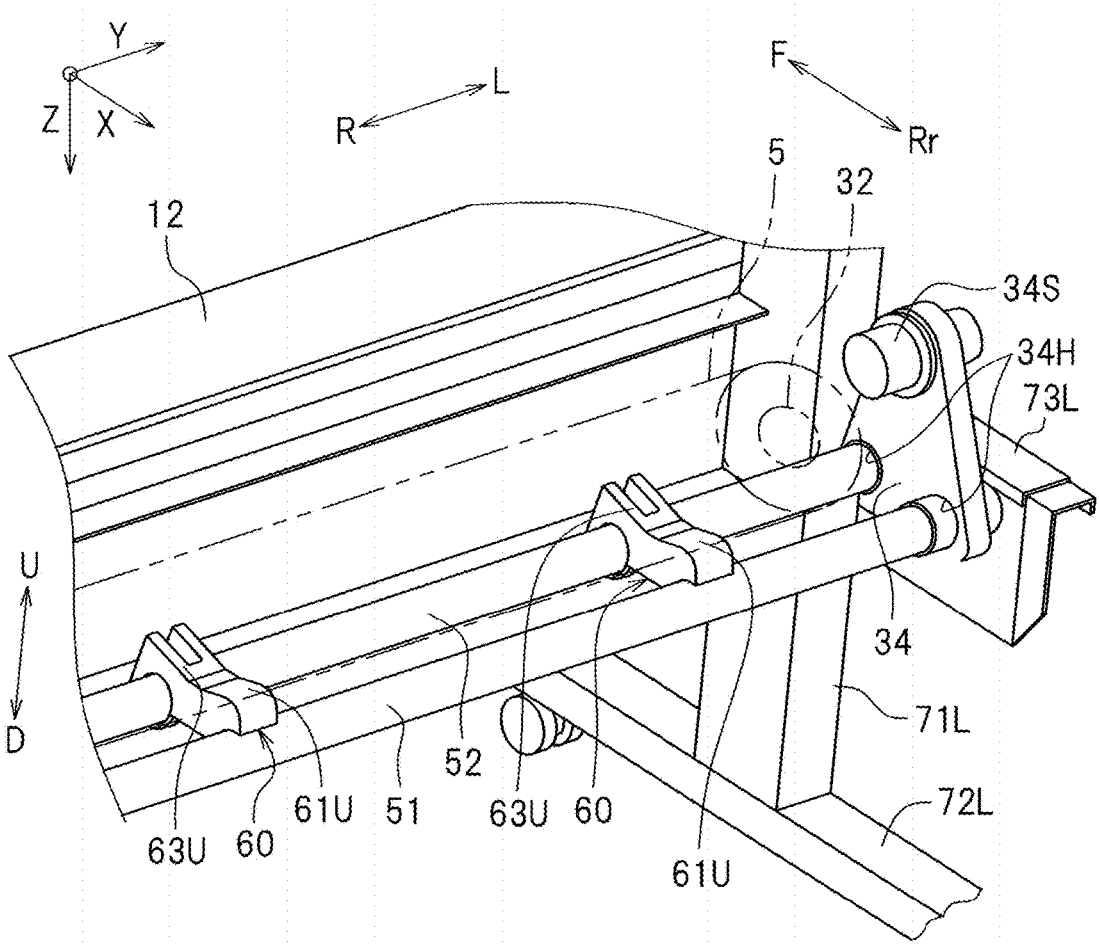
FIG. 5 is a partial perspective view of a state in which a roll medium is placed on a medium temporary placement support of the printer shown in FIG. 1.

In the case in which the roll medium 5 is attached to the medium supplier 30 by using the placement seats 60, the user first lifts the roll medium 5 and temporarily places the roll medium 5 on the placement seats 60 of the medium temporary placement support 50 (see FIG. 5). Next, a hand is placed between the slide bars 51, 52 in the longitudinal direction X (a clearance provided between a pair of the slide bars 51, 52 and the roll medium 5 temporarily placed on the placement seats 60), so as to push one end (a right end portion or a left end portion) of the roll medium 5, which is temporarily placed on the placement seats 60, to the upward portion U. Then, one end of the supply shaft 32 of the roll medium 5 is attached to the first holder 33 or the second holder 34 of the medium supplier 30. Next, the other end of the roll medium 5, which is temporarily placed on the placement seat 60, is pushed to the upward portion U, so as to attach the other end (the other of the right end portion or the left end portion) of the supply shaft 32 of the roll medium 5 to the first holder 33 or the second holder 34 of the medium supplier 30. In this way, the roll medium 5 is attached to the medium supplier 30.

Figure 6:
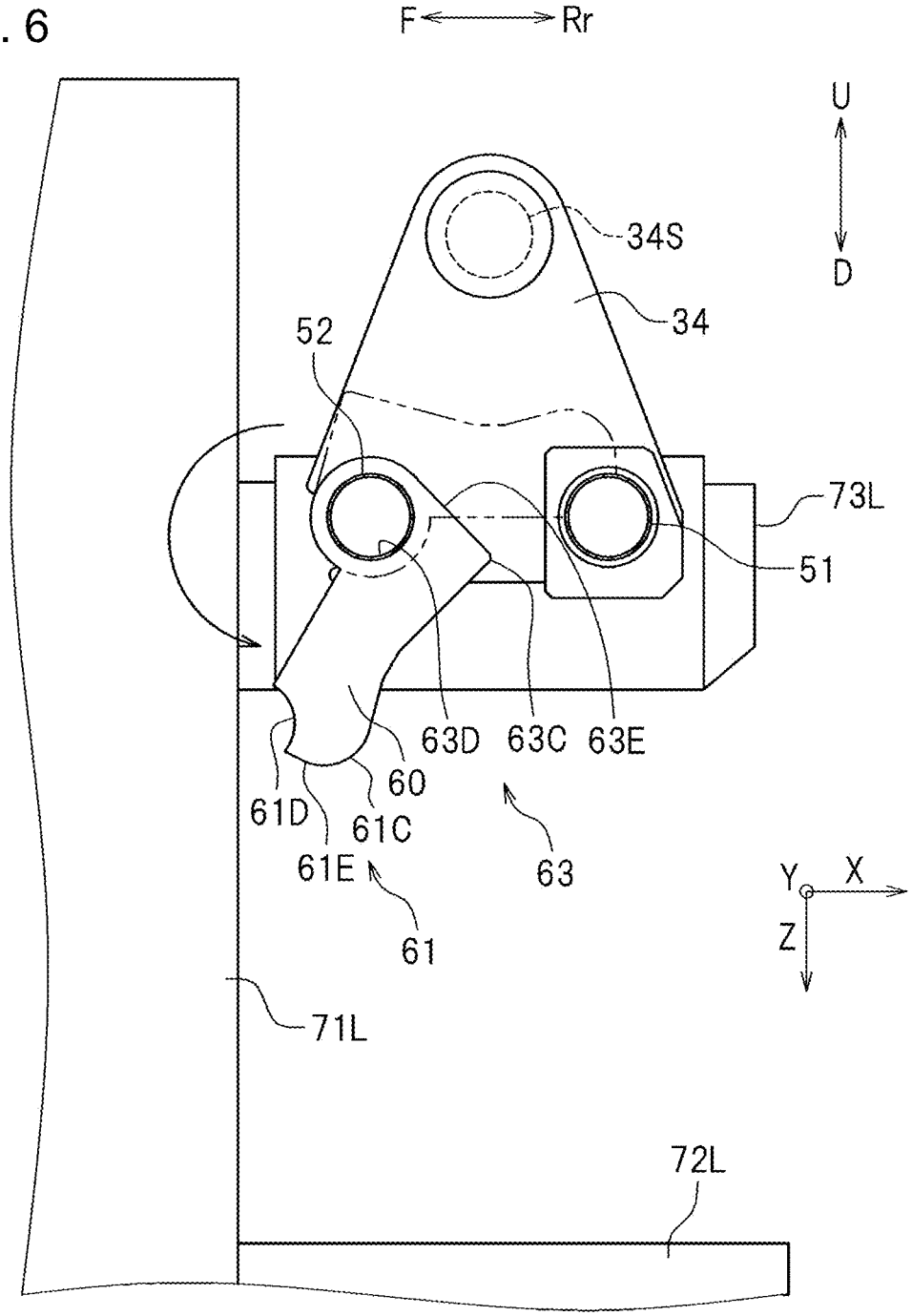
FIG. 6 is a cross-sectional view of the medium temporary placement support at the time when the placement seat is not used, according to a preferred embodiment of the present invention.

Note that, in the case in which an extra-large roll medium with a medium diameter that is prominently large (irregular), and the extra-large roll medium is temporarily placed on the placement seat 60, a height of a supply shaft of the extra-large roll medium possibly becomes higher than the height of each of the holders 33, 34 of the medium supplier 30. In such a case, before the extra-large roll medium is temporarily placed on the medium temporary placement support 50, as shown in FIG. 6, each of the placement seats 60 rotates forward F with the downstream slide bar 52 as an axis. Consequently, each of the placement seats 60 hangs down from the downstream slide bar 52 with the upstream portion 61 located on the lower side, and comes to rest at a position where static equilibrium of its own weight is achieved. In other words, when each placement seat 60 is rotated about the downstream slide bar 52 and is not supported by the upstream slide bar 51, the placement seat 60 extends down from the downstream slide bar 52. Each of the placement seats 60 comes to be at rest in a state in which the upstream end surface 61E is located below the downstream end surface 63E, for example, in a state in which the upstream end surface 61E is located below the through hole 63D. In this way, the placement seats 60 are moved from the top of each of the slide bars 51, 52 without completely detaching the placement seats 60 from the printer 10. Thereafter, in such a state, the extra-large roll medium is temporarily and directly placed on the slide bars 51, 52 of the medium temporary placement support 50. Thus, both ends of the extra-large roll medium, which is temporarily placed on the slide bars 51, 52, are attached to the holders 33, 34 of the medium supplier 30.

The controller 80 controls operation of each element of the printer 10. The controller 80 is electrically connected to the carriage motor 17 for the carriage 26, the feed motor for the grit roller 22, the ink head 27, the cutting head 28, and the winding motor 44 of the medium winding device 40, and controls these components. As shown in FIG. 1, the controller 80 includes a printing controller 81, a cutting controller 82, and a backward feeder 83.

The printing controller 81 is configured or programmed to control the printing operation on the medium 5A. The printing controller 81 controls driving of the carriage motor 17 so as to control the movement of the ink head 27 in the lateral direction Y. The printing controller 81 controls driving of the feed motor so as to control the movement of the medium 5A in the conveyance direction (for example, to the front F and the rear Rr in the longitudinal direction X). The printing controller 81 controls a timing at which the ink head 27 discharges the ink onto the medium 5A and a discharge amount of the ink. The printing controller 81 controls driving of the winding motor 44 so as to cause the winding shaft 41 to rotate and wind the medium 5A around the winding shaft 41.

The cutting controller 82 is configured or programmed to control the cutting operation of the medium 5A. The cutting controller 82 controls driving of the carriage motor 17 so as to control the movement of the cutting head 28 in the lateral direction Y. The cutting controller 82 controls driving of the feed motor so as to control the movement of the medium 5A in the conveyance direction (for example, to the front F and the rear Rr in the longitudinal direction X). The cutting controller 82 controls the movement of the cutting head 28 in the vertical direction Z and a pressure of the cutter. The cutting controller 82 controls driving of the winding motor 44 so as to cause the winding shaft 41 to rotate and wind the medium 5A around the winding shaft 41.

The backward feeder 83 controls driving of the feed motor at the timing such as before the operation of the printing controller 81, after the operation of the printing controller 81, before the operation of the cutting controller 82, or after the operation of the cutting controller 82, so as to cause the medium 5A, which is conveyed to the downstream side in conjunction with the operation of the printing controller 81, to move to the upstream side in the conveyance direction (the rear Rr in the longitudinal direction X).

The controller 80 is not particularly limited. The controller 80 is typically a computer. The controller 80, for example, includes an interface (I/F) that receives printing data, cutting data, and the like from external equipment such as a host computer; a central processing unit (CPU) that executes commands of a control program; a read only memory (ROM) that stores the program to be executed by the CPU; a random access memory (RAM) that is used as a working area where the program is loaded; and a storage medium such as memory to store various types of data.

Figure 7:
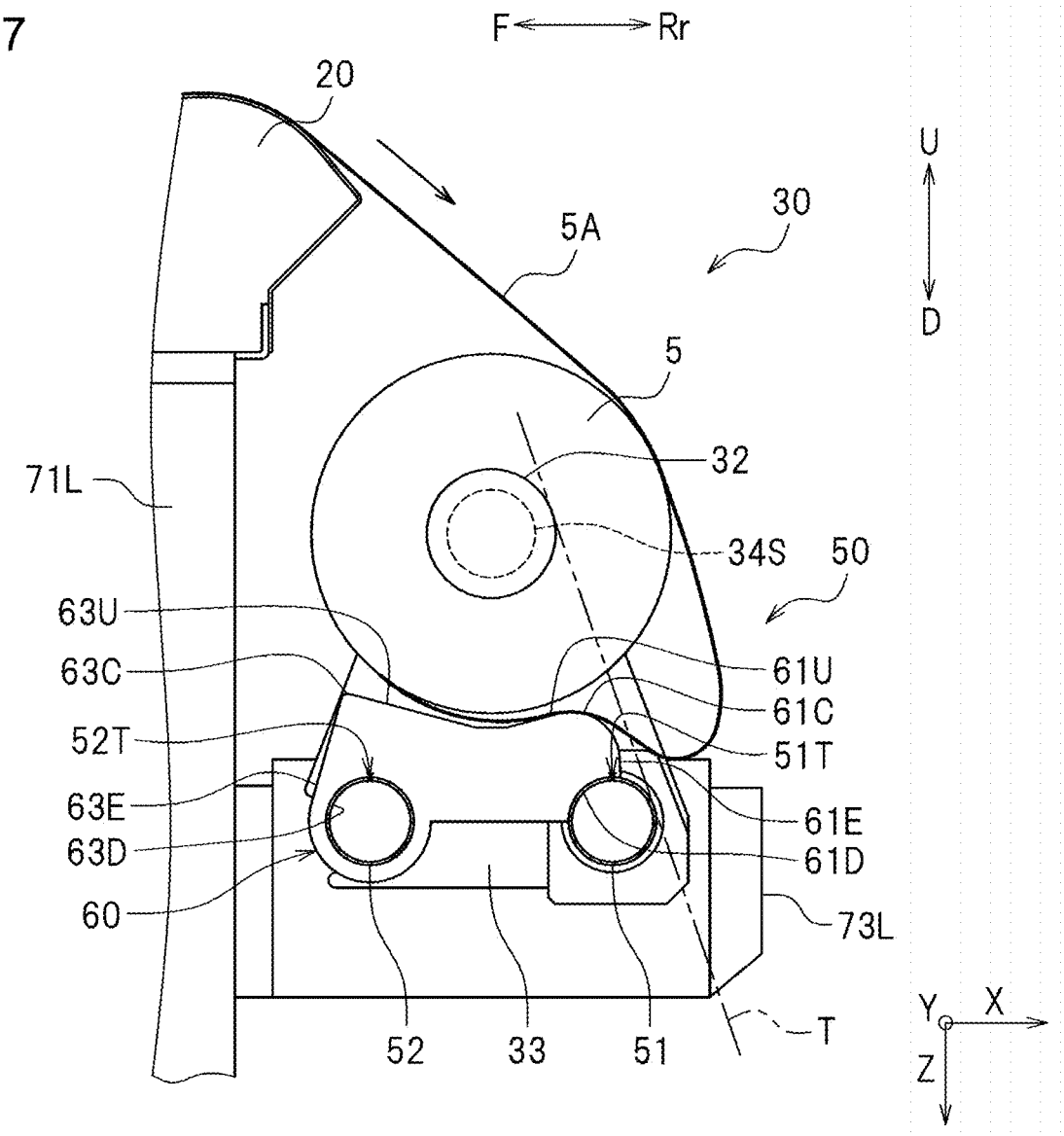
FIG. 7 is a cross-sectional view of a state in which the medium is fed backward in a preferred embodiment of the present invention.

FIG. 7 is a cross-sectional view of a state in which the medium 5A is fed backward to the upstream side by the backward feeder 83. That is, in an example of the control of the printer 10, the printing controller 81 uses the grit roller 22 to convey the medium 5A to the downstream side in the conveyance direction (the front F in the longitudinal direction X) during printing. Once printing is finished, the backward feeder 83 causes the grit roller 22 to rotate in a reverse direction from the direction during printing. In this way, the medium 5A is fed backward to the upstream side in the conveyance direction (the rear Rr in the longitudinal direction X). In the present preferred embodiment, the printer 10 does not include the motor that causes the supply shaft 32 to rotate. Accordingly, the medium 5A that returns toward the rear Rr from the platen 20 by backward feeding is not wound around the supply shaft 32, and is brought into a sagging state between the platen 20 and the roll medium 5 as shown in FIG. 7.

In the printer 10 of the present preferred embodiment, each of the placement seats 60 of the medium temporary placement support 50 has the asymmetrical shape in the conveyance direction, and the upstream end portion (the curved portion 61C) of the upstream-side placement surface 61U is curved in comparison with the downstream end portion (the corner portion 63C) of the downstream-side placement surface 63U. Unlike the corner portion 63C, the curved portion 61C has no pointing portion. Thus, the medium 5A is less likely to be stuck by the upstream portion 61. In the printer 10 of the present preferred embodiment, each of the placement seats 60 is not bulged to the upstream side in the conveyance direction from a tangent line T that contacts the upstream side of the outer circumferential surface of the supply shaft 32 and the upstream side of the outer circumferential surface of the upstream slide bar 51. Accordingly, the medium 5A, which is fed backward, is guided to the downstream side along the curvature of the curved portion 61C of each of the placement seats 60 without being folded. In addition, the curved portion 61C is curved. Thus, compared to the case in which the curved portion 61C is not curved, a projected amount of the curved portion 61C to the upstream side in the conveyance direction is reduced. In this way, the path of the medium 5A, which is fed backward, is unlikely to be blocked by the placement seats 60. Thus, it is possible to significantly reduce or prevent the medium 5A from being folded or twisted.

Figure 8:
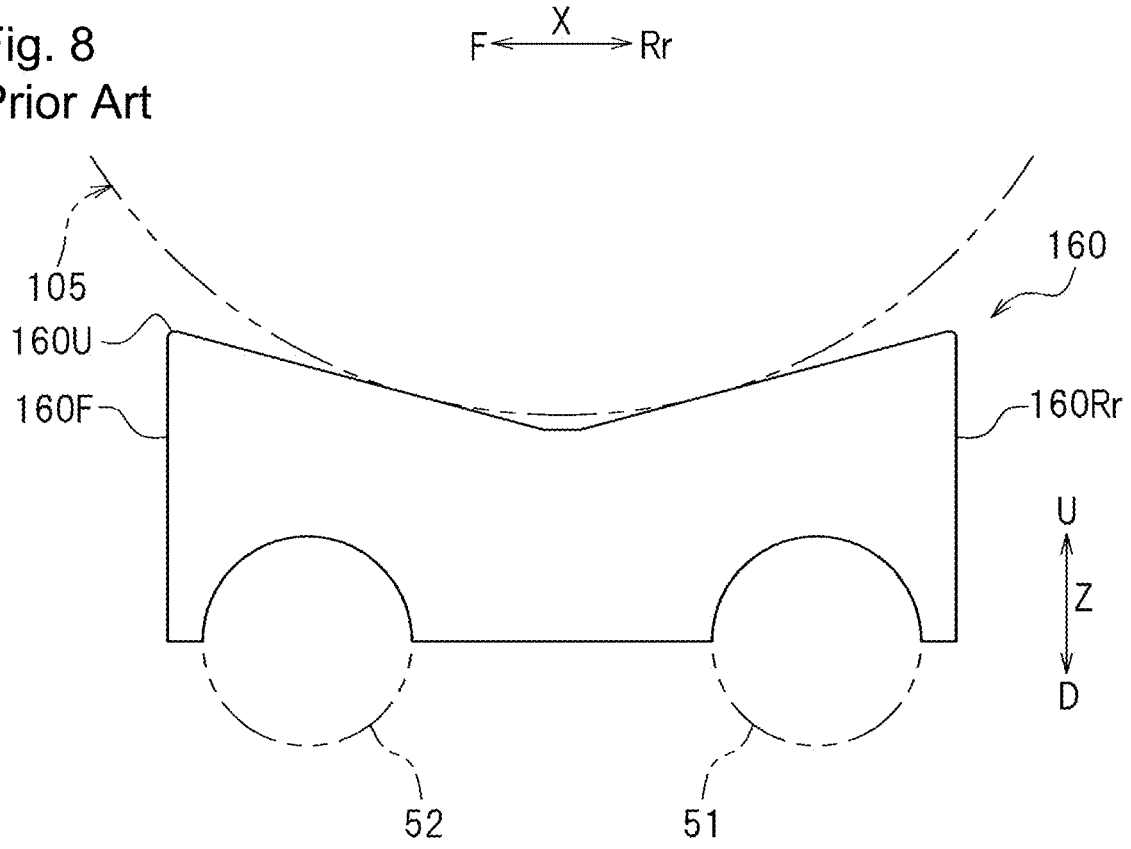
Fig. 8 Prior Art
FIG. 8 is a cross-sectional view that schematically shows a conventional placement unit.

Note that FIG. 8 is a cross-sectional view of a conventional placement seat 160 as described in JP-A-2012-153456 as a reference. The placement seat 160 in FIG. 8 has a symmetrical shape in the conveyance direction (the longitudinal direction X). The placement seat 160 includes lateral wall portions 160F, 160Rr, each of which extends in the vertical direction Z, in both end portions (at the front F and the rear Rr) in the conveyance direction. In this way, in the placement seat 160, a large area of an upper surface 160U is secured to increase a contact area with a roll medium 105, so as to stably place the roll medium 105 thereon. However, with such a configuration, in the case in which the medium is fed backward to the upstream side (the rear Rr in the longitudinal direction X), there is a high possibility that the roll medium 105 and the placement seat 160 interfere with each other and that the roll medium 105 is possibly folded at a corner portion of the lateral wall portion 160Rr extending in the vertical direction Z. Thus, it is considered that there is a relatively high risk of interference between the placement seat 160 and the medium in the printer including the placement seat 160 when compared to the printer 10 of the present preferred embodiment.

According to the present preferred embodiment, the upstream (rear Rr in the longitudinal direction X) portion and the downstream (the front F in the longitudinal direction X) portion of the placement seat 60 have different shapes. Accordingly, compared to the case in which the upstream portion and the downstream portion have the same shape, it is possible to prevent the erroneous assembly of the placement seat 60 in the longitudinal direction X during manufacturing of the printer 10.

According to a preferred embodiment of the present invention, each of the placement seats 60 includes the corner portion 63C, the height of which from the slide bars 51, 52 is higher than the height on the upstream side (at the rear Rr in the longitudinal direction X) thereof, in the downstream end (the front F in the longitudinal direction X) portion of the downstream-side placement surface 63U. In the present preferred embodiment, the upstream-side placement surface 61U includes the curved portion 61C. Thus, compared to the case in which the curved portion 61C is not provided, a movable range of the roll medium 5 on the upstream-side placement surface 61U is reduced. Accordingly, the roll medium 5 easily rolls to the downstream side (forward F in the longitudinal direction X). In addition, the corner portion 63C is provided on the downstream side (at the front F in the longitudinal direction X) in a rolling direction of the roll medium 5. Thus, the roll medium 5 is unlikely to roll when the roll medium 5 is placed on the placement seat 60. In this way, it is possible to reduce a risk that the roll medium 5 suddenly falls from the placement seat 60.

According to a preferred embodiment of the present invention, when seen in the axial direction of the supply shaft 32, the upstream (the rear Rr in the longitudinal direction X) end of the placement seat 60 is located on the downstream side (in the front F in the longitudinal direction X) of the upstream (the rear Rr in the longitudinal direction X) end of the upstream slide bar 51. Accordingly, the medium 5A, which is fed backward, is less likely to be stuck by the upstream portion 61 of the placement seat 60. Thus, the path of the medium 5A, which is fed backward, is appropriately secured.

According to a preferred embodiment of the present invention, the support bars are the slide bars 51, 52, each of which extends in parallel or substantially parallel with the supply shaft 32, and which are parallel or substantially parallel with each other. The slide bars 51, 52 include the upstream slide bar 51 located on an upstream side (the rearmost side Rr in the longitudinal direction X) of the downstream slide bar 52. The outer circumferential surface of the upstream slide bar 51 has a circular or substantially circular shape. When seen in the axial direction of the supply shaft 32, the curvature of the curved portion 61C in the placement seat 60 is equal or substantially equal to the curvature of the upstream slide bar 51. In this way, the medium 5A, which is fed backward, is guided to the upstream side such that a folded angle thereof becomes gentle. Accordingly, the medium 5A smoothly moves to the upstream side.

According to a preferred embodiment of the present invention, when seen in the axial direction of the supply shaft 32, the placement seat 60 is located on the downstream side (in the front F in the longitudinal direction X) of the tangent line T that contacts the upstream side (the rear Rr in the longitudinal direction X) of the outer circumferential surface of the supply shaft 32 and the upstream side (the rear Rr in the longitudinal direction X) of the outer circumferential surface of the slide bar 51. In this way, the path of the medium 5A, which is fed backward, is appropriately secured. Thus, it is possible to significantly reduce or prevent the medium 5A from being folded or twisted.

According to a preferred embodiment of the present invention, the support bar includes the downstream slide bar 52 located on the downstream side (in the front F in the longitudinal direction X) of the slide bar 51. The supported portion of the placement seat 60 includes the through hole 63D that has the diameter equal to or larger than the outer diameter of the downstream slide bar 52 and extends through the supported portion in the axial direction. The downstream slide bar 52 extends through the through hole 63D. In this way, it is possible to prevent the placement seat 60 from separating or falling from the slide bars 51, 52 due to the momentum at the time when the roll medium 5 is placed on the placement seat 60.

According to a preferred embodiment of the present invention, the placement seat 60 is rotatably supported by the downstream slide bar 52. When the placement seat 60 rotates forward F with the downstream slide bar 52 being the axis, the placement seat 60 hangs down from the downstream slide bar 52 in the state in which the upstream end surface 61E is located below the through hole 63D. In this way, when the placement seat 60 is not used, for example, when the extra-large roll medium having the large medium diameter is used for printing, the placement seats 60 are able to be moved from the top of each of the slide bars 51, 52 without completely detaching the placement seats 60 from the printer 10. Accordingly, there is no need to worry about a place to keep the detached placement seat 60, and the placement seat 60 is not lost. In addition, when the placement seat 60 is used again, the placement seat 60 rotates toward the rear Rr with the downstream slide bar 52 as an axis. In this way, the placement seat 60 is easily returned onto the slide bars 51, 52.

According to a preferred embodiment of the present invention, the printer 10 further includes the platen 20 located on the downstream side (in the front F in the longitudinal direction X) of the medium supplier 30 and on which the medium 5A is placed during printing; and the cutting head 28 that cuts the medium 5A placed on the platen 20. In such a case, it is considered that a large portion of the medium 5A is fed backward, for example, when the printing operation is finished. Therefore, the effects of the technique disclosed herein are easily achieved.

The description has been made so far of the printers according to various preferred embodiments of the present invention. However, the printer 10 described above according to various preferred embodiments of the present invention are merely illustrative, and the present invention can be implemented in various other modes. The present invention can be implemented based on the contents disclosed in the present specification and common general technical knowledge in this field. The techniques described in the claims includes various modifications and changes that are made to the above-exemplified preferred embodiments. For example, one or more elements of the above preferred embodiments may be replaced with other modified aspects of the preferred embodiments, and the other modified aspects may be added to the above preferred embodiments. In addition, the above preferred embodiments and the modified aspects may appropriately be combined. Furthermore, when any of the technical features is not described as being essential, the technical feature(s) may be appropriately be eliminated.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A printer for printing on a roll medium including a supply shaft and a medium wound around the supply shaft, the printer comprising:

a medium supplier including a shaft support, to which the supply shaft of the roll medium is detachably attached, and that rotatably supports the roll medium;

a medium temporary placement support that is located below the shaft support of the medium supplier, and that receives and supports the roll medium prior to the roll medium being attached to the medium supplier; and a conveyor that conveys the medium in a conveyance direction that is perpendicular or substantially perpendicular to an axial direction of the supply shaft, the medium being unwound from the supply shaft; wherein the medium temporary placement support includes at least one support bar that extends in the axial direction, and a placement seat supported by the at least one support bar;

the placement seat includes a placement surface on which the roll medium is placed and that extends in the conveyance direction, and a curved portion that includes a convex curve in an upstream end portion of the placement surface in the conveyance direction; and an upstream portion of the placement seat in the conveyance direction has a different shape than a downstream portion of the placement seat in the conveyance direction.

2. The printer according to claim 1, wherein the placement seat includes a corner portion in a downstream end portion of the placement surface in the conveyance direction; and in the conveyance direction, a height of the corner portion from the at least one support bar is greater than a height of the upstream portion of the placement seat from the at least one support bar.

3. The printer according to claim 1, wherein when seen in the axial direction of the supply shaft, the upstream end portion of the placement seat in the conveyance direction is located on a downstream side in the conveyance direction of an upstream end portion of the at least one support bar in the conveyance direction.

4. The printer according to claim 1, wherein the at least one support bar includes a plurality of support bars, each of which extends parallel or substantially parallel to the supply shaft;

the plurality of support bars includes an upstream support bar located on an upstream side of at least one other support bar of the plurality of support bars in the conveyance direction;

an outer circumferential surface of the upstream support bar has a circular or substantially circular shape; and when seen in the axial direction of the supply shaft, a curvature of the convex curve of the curved portion of the placement seat is equal to or smaller than a curvature of the upstream support bar.

5. The printer according to claim 4, wherein when seen in the axial direction of the supply shaft, the placement seat is located on a downstream side in the conveyance direction of a tangent line that contacts an upstream side of an outer circumferential surface of the supply shaft and an upstream side of an outer circumferential surface of the upstream support bar.

6. The printer according to claim 4, wherein the upstream portion of the placement seat includes a concave curve that contacts the upstream support bar.

7. The printer according to claim 6, wherein a curvature of the concave curve is equal or substantially equal to a curvature of the upstream support bar.

8. The printer according to claim 1, wherein the at least one support bar includes a plurality of support bars, each of which extends parallel or substantially parallel to the supply shaft;

the plurality of support bars includes an upstream support bar that is located on an upstream side of at least one other support bar of the plurality of support bars in the conveyance direction;

an outer circumferential surface of the upstream support bar has a circular or substantially circular shape; and the plurality of support bars includes a downstream support bar that is located on a downstream side of the upstream support bar in the conveyance direction;

the placement seat includes a through hole having a diameter equal to or larger than an outer diameter of the downstream support bar and that extends through the placement seat in the axial direction; and the downstream support bar extends through the through hole.

9. The printer according to claim 8, wherein the placement seat is rotatably supported by the downstream support bar; and when the placement seat is rotated about the downstream support bar and is not supported by the upstream support bar, the placement seat extends downward from the downstream support bar in a state in which an upstream end surface is located below the through hole.

10. The printer according to claim 1, further comprising:

a second placement seat including a second placement surface on which the roll medium is placed and that extends in the conveyance direction.

11. A printer for printing on a roll medium including a supply shaft and a medium wound around the supply shaft, the printer comprising:

a medium supplier including a shaft support, to which the supply shaft of the roll medium is detachably attached, and that rotatably supports the roll medium;

a medium temporary placement support that is located below the shaft support of the medium supplier, and that receives and supports the roll medium prior to the roll medium being attached to the medium supplier;

a conveyor that conveys the medium in a conveyance direction that is perpendicular or substantially perpendicular to an axial direction of the supply shaft, the medium being unwound from the supply shaft;

a platen located on a downstream side of the medium supplier in the conveyance direction and on which the medium is placed during printing; and a cutting head that cuts the medium placed on the platen; wherein the medium temporary placement support includes at least one support bar that extends in the axial direction, and a placement seat supported by the at least one support bar; and the placement seat includes a placement surface on which the roll medium is placed and that extends in the conveyance direction, and a curved portion that includes a convex curve in an upstream end portion of the placement surface in the conveyance direction.

* * * * *